US007641445B1

(12) United States Patent
Liang

(10) Patent No.: US 7,641,445 B1
(45) Date of Patent: Jan. 5, 2010

(54) LARGE TAPERED ROTOR BLADE WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 445 days.

(21) Appl. No.: 11/607,586

(22) Filed: Dec. 1, 2006

(51) Int. Cl.
*F01D 5/18* (2006.01)

(52) U.S. Cl. ..... 416/97 R

(58) Field of Classification Search ..... 415/115; 416/96 R, 97 R
See application file for complete search history.

(56) References Cited

U.S. PATENT DOCUMENTS

| | | | | |
|---|---|---|---|---|
| 2,920,865 | A | 1/1960 | Lombard | |
| 4,302,153 | A * | 11/1981 | Tubbs | 416/96 R |
| 4,786,233 | A | 11/1988 | Shizuya et al. | |
| 5,350,277 | A | 9/1994 | Jacala et al. | |
| 5,403,157 | A | 4/1995 | Moore | |
| 5,690,472 | A | 11/1997 | Lee | |
| 5,702,232 | A | 12/1997 | Moore | |
| 5,779,447 | A | 7/1998 | Tomita et al. | |
| 5,941,687 | A | 8/1999 | Tubbs | |
| 5,993,156 | A | 11/1999 | Bailly et al. | |
| 6,004,100 | A | 12/1999 | Przirembel et al. | |
| 6,132,169 | A | 10/2000 | Manning et al. | |
| 6,152,695 | A | 11/2000 | Fukue et al. | |
| 6,164,913 | A | 12/2000 | Reddy | |
| 6,227,804 | B1 * | 5/2001 | Koga et al. | 416/96 R |
| 6,254,346 | B1 | 7/2001 | Fukuno et al. | |
| 6,257,831 | B1 * | 7/2001 | Papple et al. | 416/97 R |
| 6,264,428 | B1 | 7/2001 | Dailey et al. | |
| 6,551,062 | B2 | 4/2003 | Leeke et al. | |
| 6,616,406 | B2 | 9/2003 | Liang | |
| 6,641,362 | B1 | 11/2003 | Anding et al. | |
| 6,811,378 | B2 | 11/2004 | Kraft | |
| 6,874,987 | B2 | 4/2005 | Slinger et al. | |
| 6,910,864 | B2 | 6/2005 | Tomberg | |

* cited by examiner

*Primary Examiner*—Edward Look
*Assistant Examiner*—Ryan H Ellis
(74) *Attorney, Agent, or Firm*—John Ryznic

(57) ABSTRACT

A turbine rotor blade for use in a gas turbine engine, the blade including a serpentine flow cooling circuit that includes a first leg forming a leading edge cooling channel, a second leg that includes an upper channel with trip strips and a lower portion with near wall cooling channels that split off from the upper portion of the second leg to form near wall cooling channels extending along the pressure side and the suction side of the blade, the near wall cooling channels being separated by a dead cavity, and a third leg formed along the trailing edge of the blade with a collecting cavity formed in the blade root and providing the fluid communication between the trailing edge third leg and the near wall cooling channels. The trailing edge channel is connected to a plurality of metering and diffusion holes spaced along the trailing edge. These exit holes include a metering hole, a first diffusion hole, and a diffusion slot located on the pressure side of the trailing edge of the blade. A plurality of the metering and diffusion holes opens into a single diffusion slot. The diffusion slots each include a second diffusion hole and a third diffuser arranged in series.

9 Claims, 5 Drawing Sheets

LARGE TAPERED ROTOR BLADE WITH NEAR WALL COOLING

BACKGROUND OF THE INVENTION

1. Field of the Invention

The present invention relates generally to fluid reaction surfaces, and more specifically to large turbine airfoils with a cooling circuit.

2. Description of the Related Art including information disclosed under 37 CFR 1.97 and 1.98

A gas turbine engine is very efficient machine that converts the chemical energy of a burning fuel into mechanical energy. An industrial gas turbine (IGT) engine is used in power plants to drive an electric generator to produce electric power. The efficiency of a gas turbine engine can be increased by increasing the high temperature gas flow that enters the turbine. It is a very important design feature to provide for the first stage stator vanes and rotor blades to have as high of a high heat resistance as possible by using high temperature resistant materials in combination with internal and film cooling of the airfoils (vanes and blades).

In the recent history of industrial gas turbine engines, because the turbine inlet temperature was not too high, only the first and second stages of stator vanes and rotor blades required cooling. With the recent improvement in airfoil materials and cooling, the turbine inlet temperature has increased to the point where the third stage and even the fourth stage airfoils require cooling in order to have a long life time. Even though the gas flow temperature acting on the fourth stage rotor blades is not high enough to melt the blades, the temperature is high enough to result in creep and other thermal effects on the blades that will shorten the blade's life time in operation. It is desirable to design a fourth stage blade for 96,000 hours of operation in order to reduce the high cost of replacing these blades.

Also, because the inlet temperature to the fourth stage rotor blades is high enough, the size of these blades must be increased in order to maximize the energy extracted from the hot gas flow. As the fourth stage rotor blades increase in length, the twisting that results on the airfoil causes problems with creating the cooling holes within the blades. Straight or radial holes cannot be drilled from tip to root because of the twist. In addition, the core ties used in casting the internal passages within these blades are easily damaged in the molds, and as a result defective blades are cast.

Another problem with large turbine rotor blades is the effect of such a relatively large mass due to rotation of the blade under extreme high temperature. The centrifugal force on the rotating blade in addition to the high temperature will lead to creep problems or to the blade untwisting due to deformation. The aero-performance of the blade and well as the remaining life of the blade will both decrease.

Prior art cooling of large turbine rotor blade is achieved by drilling radial holes into the blade from the blade tip and root sections. Limitations of drilling a long radial hole from both ends of the airfoil increases for a large and highly twisted and tapered blade. Reduction of available airfoil cross sectional area for drilling radial holes is a function of the blade twist and taper. Higher airfoil twist and taper yield a lower available cross sectional area for drilling radial cooling holes. Cooling of the large, highly twisted and tapered blade by this manufacturing technique will not achieve the optimum blade cooling effectiveness. Especially lacking is cooling for the blade leading edge and trailing edge. This prevents the use of such blades in a high firing temperature application as well as a low cooling flow design. FIG. 1 shows a prior art turbine airfoil for a large rotor blade with a cooling flow design that uses the drilling of radial cooling holes, which is U.S. Pat. No. 6,910,864 issued to Tomberg on Jun. 28, 2005 and entitled TURBINE BUCKET AIRFOIL COOLING HOLE LOCATION, STYLE AND CONFIGURATION.

U.S. Pat. No. 5,993,156 issued to Bailly et al on Nov. 30, 1999 and entitled TURBINE VANE COOLING SYSTEM discloses a turbine vane cooling system in which the vane includes a cooling air supply orifice (23 in this patent in FIGS. 2 and 12) located in the vane root which then splits up into two flows (B1 and B2 in FIG. 12 of this patent), with one path along the pressure side and the other path along the suction side. The two paths then are combined into a central cavity (# 13 and 15 in FIG. 12 of this patent), and then passes through an aperture (# 18 in this patent) located at the base and into a trailing edge channel (# 16 in this patent) in which cooling air outlet slots (# 19 in this patent) discharge the cooling air out from the vane.

U.S. Pat. No. 5,779,447 issued to Tomite et al on Jul. 14, 1998 and entitled TURBINE ROTOR discloses a rotor blade with a cooling circuit having a lower cavity (# 4 in this patent) with pin fins extending across the cooling passages formed by ribs (# 14 in this patent), and an upper portion of the blade having a plurality of holes (# 15 in this patent) extending from the lower cavity to the blade tip.

U.S. Pat. No. 6,152,695 issued to Fukue et al on Nov. 28, 2000 and entitled GAS TURBINE MOVING BLADE discloses a rotor blade in FIG. 1 of this patent with an inner cavity (# 10 in this patent) separated by ribs with pin fins extending across the cavity that extends from the root to the blade tip, and another embodiment in FIG. 15 of this patent in which the cavity stops short of the blade tip in which radial holes continue until the blade tip.

It is therefore an object of the present invention to provide for a large high tapered turbine rotor blade with internal air cooling circuit that will provide adequate cooling of the blade while also being easily cast without significant errors in the casting.

It is also another object of the present invention to provide for a large turbine rotor blade with an increase in the $AN^2$ of the prior art blades.

BRIEF SUMMARY OF THE INVENTION

Improvement for the airfoil cooling design in the Tomberg patent can be achieved by the use of a multi-pass serpentine flow cooling geometry into a highly twisted and tapered large rotor blade of the present invention. The airfoil normally consists of a large cross section area at the blade lower span height and tapered to a small blade thickness at the upper blade span height.

The turbine blade includes a triple or 3-pass serpentine flow cooling circuit with a first leg being a leading edge channel from the root to the tip. A second leg is a downward flowing mid-chord channel that starts with an upper blade span channel having trip strips therein on the pressure side wall and the suction side wall of the channel and then divides into two sets of parallel channels, with one set being a plurality of near wall cooling channels on the pressure side and the other set being a plurality of near wall cooling channels on the suction side of the blade. The two sets of near wall cooling channels merge into a root section turn and collecting cavity, and then lead into the third leg which is a trailing edge upward flowing cooling channel. A plurality of metering holes and diffusion slots lead from the third leg or trailing edge channel and open onto the suction side of the trailing edge of the blade. A dead cavity is formed between the two near wall cooling channels to lighten the blade.

At the blade lower span height, near wall cooling is used for a reduction of the cooling flow cross sectional area, especially for the blade mid-chord section where the highest thickness for the blade is found. The near wall cooling channels are utilized at the blade mid-chord section to increase the cooling through velocity and subsequently increase the cooling side internal heat transfer coefficient. Since the blade upper span geometry is very thin, using near wall cooling channels in the ceramic core may reduce the casting yields. Therefore, for the blade upper span height, trip strips are used at the blade serpentine flow channel at higher span to increase the internal heat transfer capability.

DETAILED DESCRIPTION OF THE INVENTION

The present invention is for a large turbine rotor blade used in a gas turbine engine in which the blade includes a large amount of taper and twist that makes it difficult if not impossible to form radial cooling channels from the root to the tip. However, the cooling circuit could be used in not so large rotor blades or stator vanes without departing from the spirit and scope of the invention.

Figure 3:
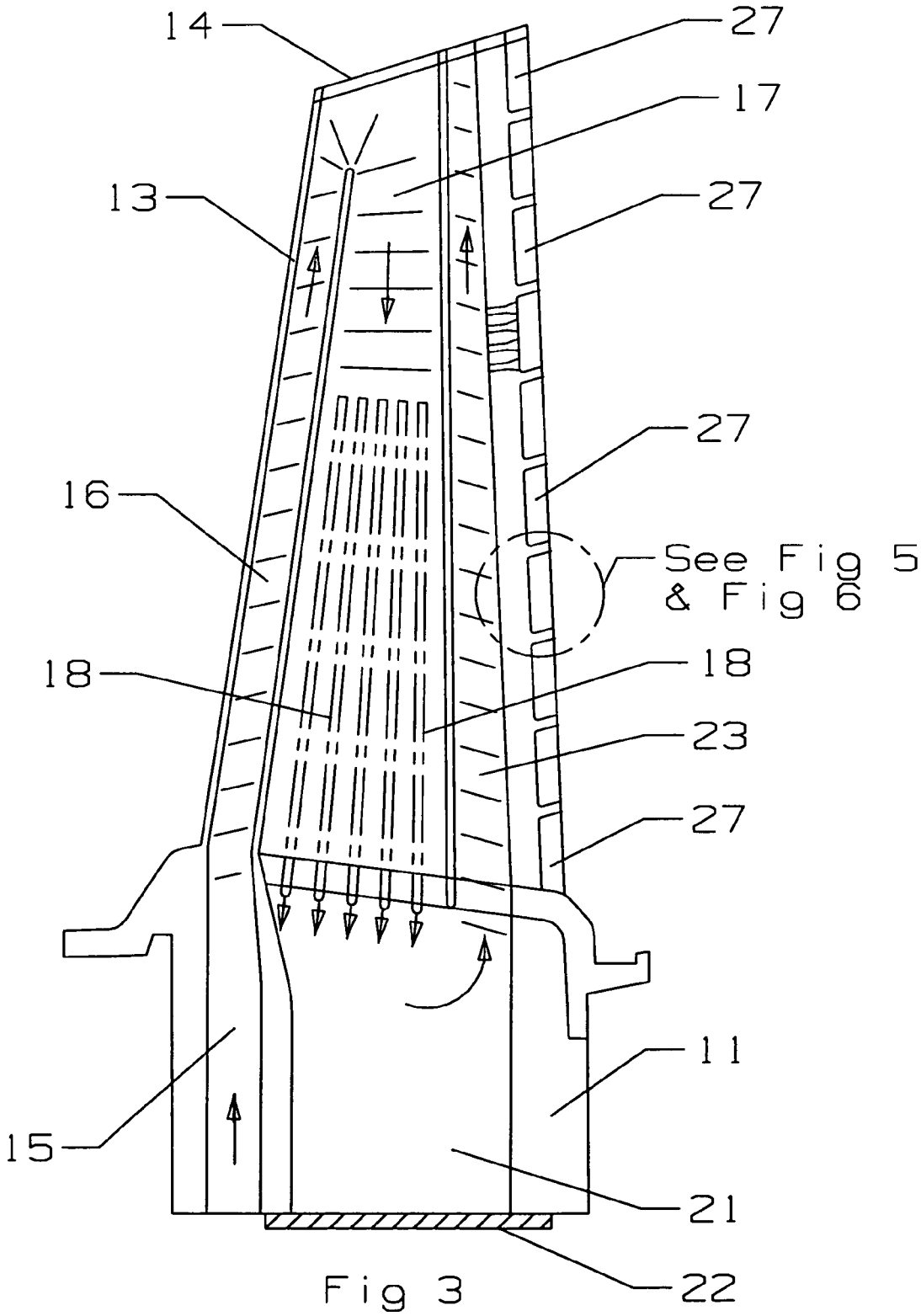
FIG. 3 shows a side view cut-away of the turbine blade near wall serpentine flow cooling circuit of the present invention.

FIG. 3 is a best representation of the serpentine flow cooling circuit in the turbine blade of the present invention. The blade includes a root portion 11, an airfoil portion 13, and a tip portion 14. A cooling air supply passage 15 is in the root portion 11 and leads into a first leg of the 3-pass serpentine flow cooling circuit. The first leg is a leading edge cooling channel 16 that extends from the root supply channel 15 to the blade tip 14 and turns into the second leg 17 at the tip 14. Trip strips are included within the leading edge channel 16 to promote turbulence within the cooling air flow.

Figure 1:
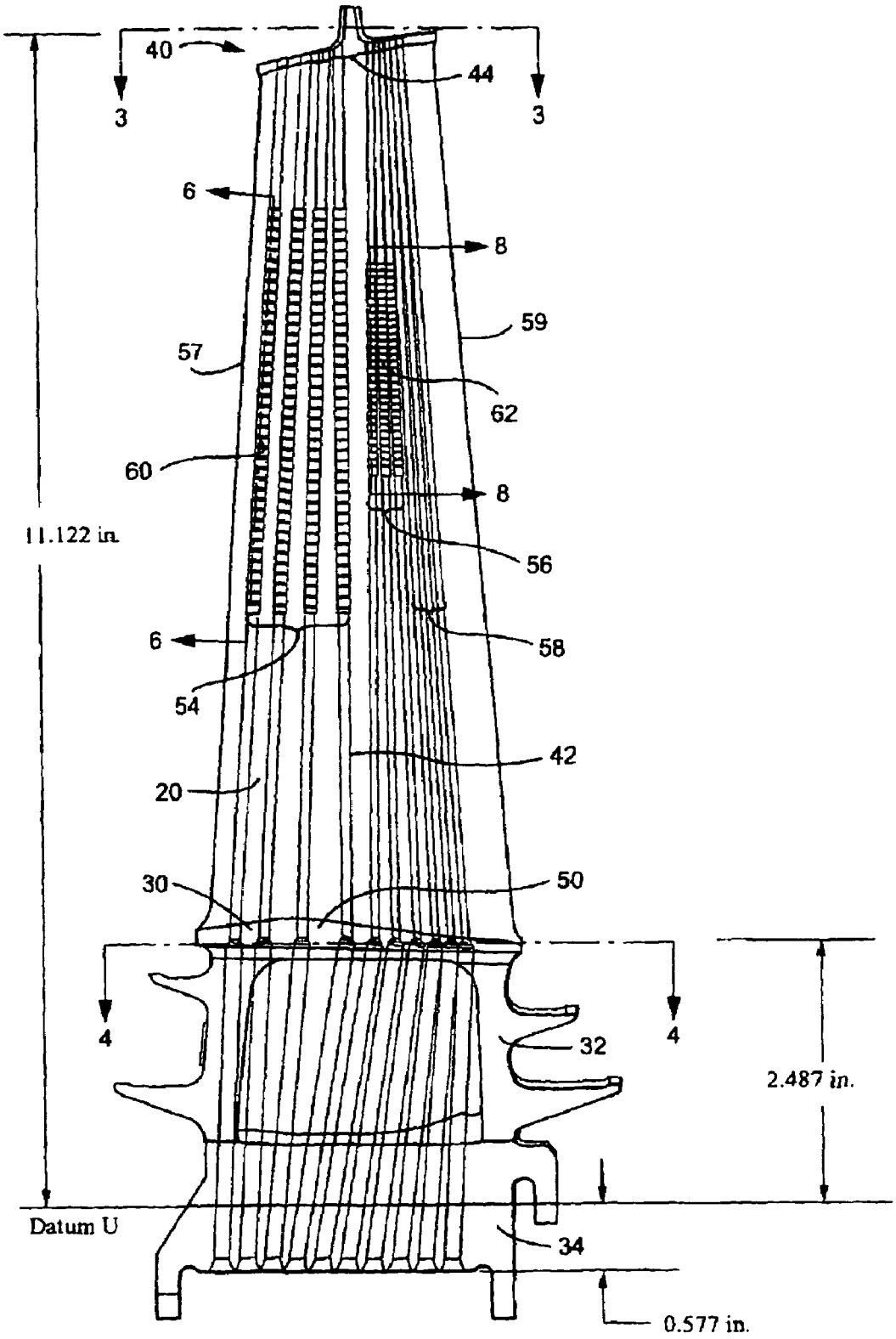
FIG. 1 shows a side cut-away view of a prior art large turbine blade with radial cooling channels.
Figure 2A:
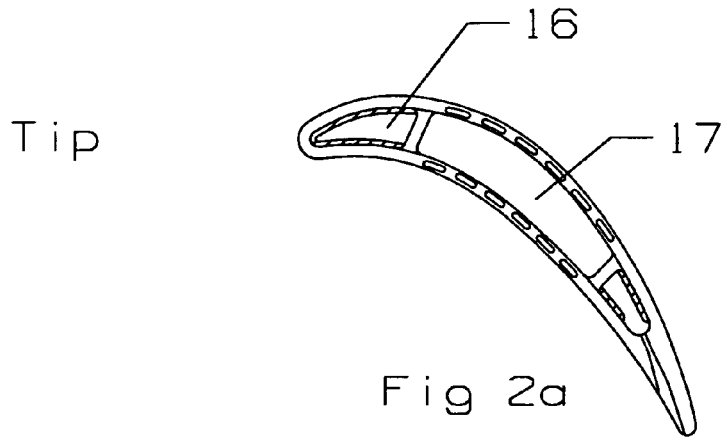
FIG. 2*a* shows a cross section view of the blade of the present invention through the tip section.
Figure 2B:
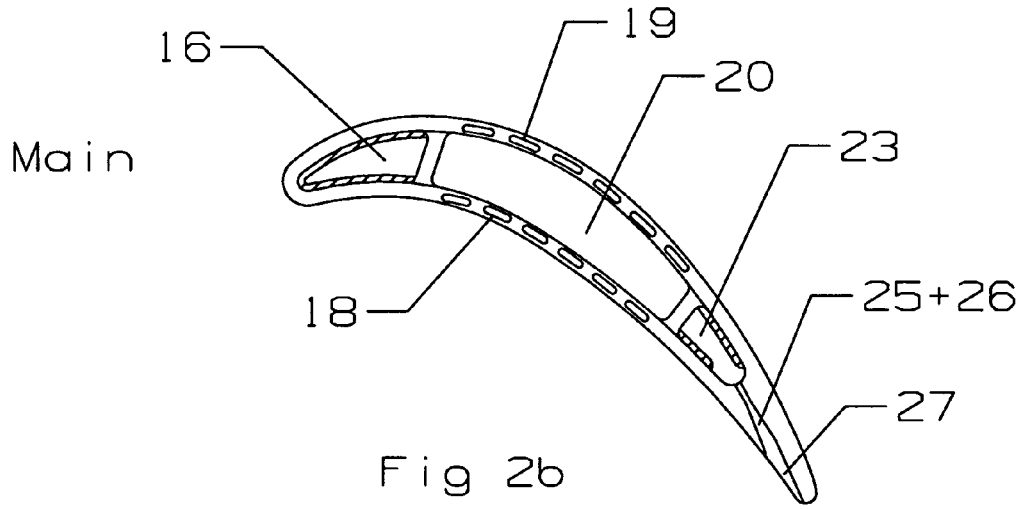
FIG. 2*b* shows a cross section view of the blade of the present invention through the middle section.
Figure 2C:
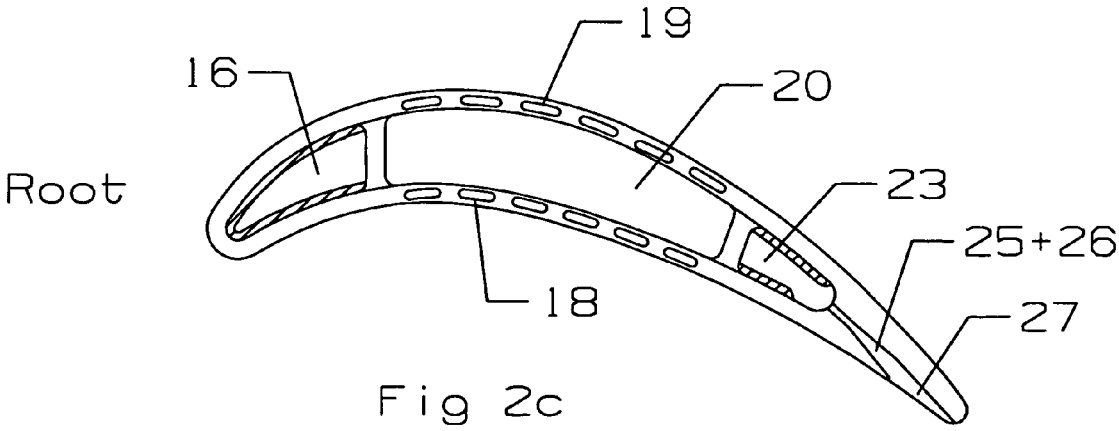
FIG. 2*c* shows a cross section view of the blade of the present invention through the root section.
Figure 4:
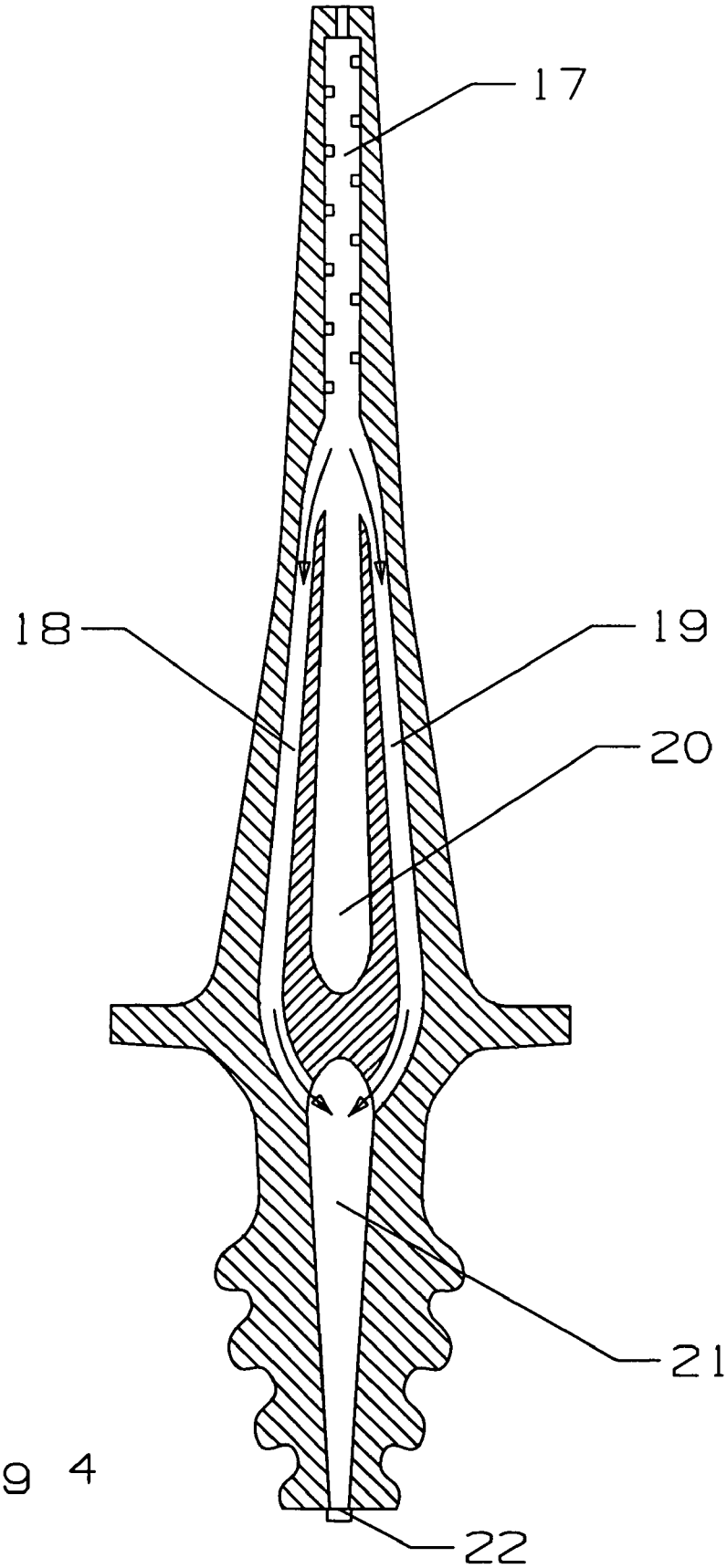
FIG. 4 shows a cross section cut-away view of the read end of the turbine blade of the present invention.

The second leg includes a single flow channel 17 in the upper blade span with trip strips. This single flow channel extends between the pressure side wall and the suction side wall of the blade as seen in FIG. 2*a*. The single flow channel 17 then splits up into two sets of near wall cooling channels extending along the length of the rest of the airfoil. The first set of channels is a plurality of near wall cooling channels 18 along the pressure side of the blade as seen in FIG. 2*b*. The second set of channels is a plurality of near wall cooling channels 19 along the suction side of the blade as seen in FIG. 2*b*. Positioned between the pressure side near wall cooling channels 18 and the suction side near wall cooling channels 19 is a dead cavity 20. The dead cavity reduces the mass of the blade, and therefore reduces the weight and the centrifugal force acting on the blade during rotation. This increases the $AN^2$ of the blade which is an important factor in large turbine blade. FIG. 4 shows a rear view of the rotor blade with the second leg of the serpentine flow circuit.

The pressure side near wall cooling channels 18 and the suction side near wall cooling channels 19 discharge the cooling air into a root section turn and collection cavity 21 located in the root portion of the blade and enclosed by a cover plate 22 as seen in FIG. 3. The combined flow is then directed upward into the third leg of the serpentine flow circuit which is the trailing edge cooling channel 23 and extends to the blade tip 14 along the trailing edge. The trailing edge cooling channel 23 includes trip strips extending along this channel where needed to promote turbulence in the cooling air flow.

Figure 5:
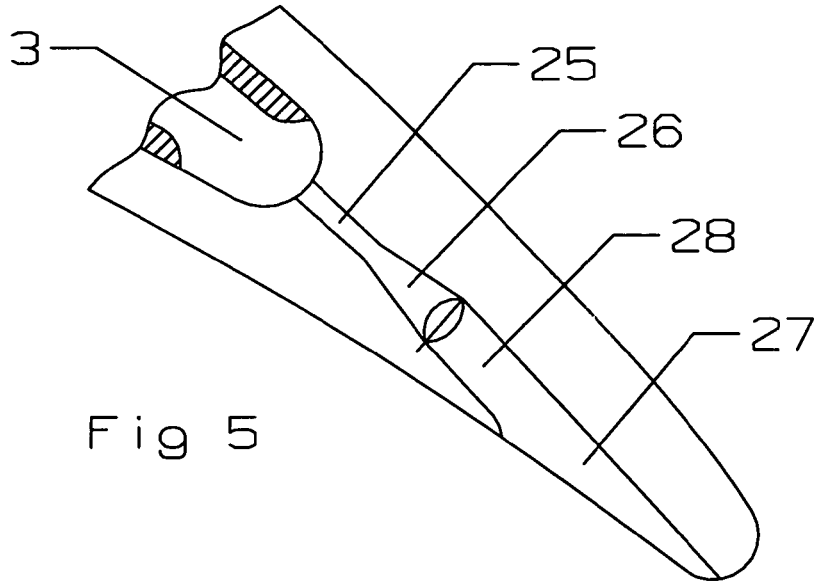
FIG. 5 shows a cross section top view of the details of the trailing edge metering holes and diffusion slot.
Figure 6:
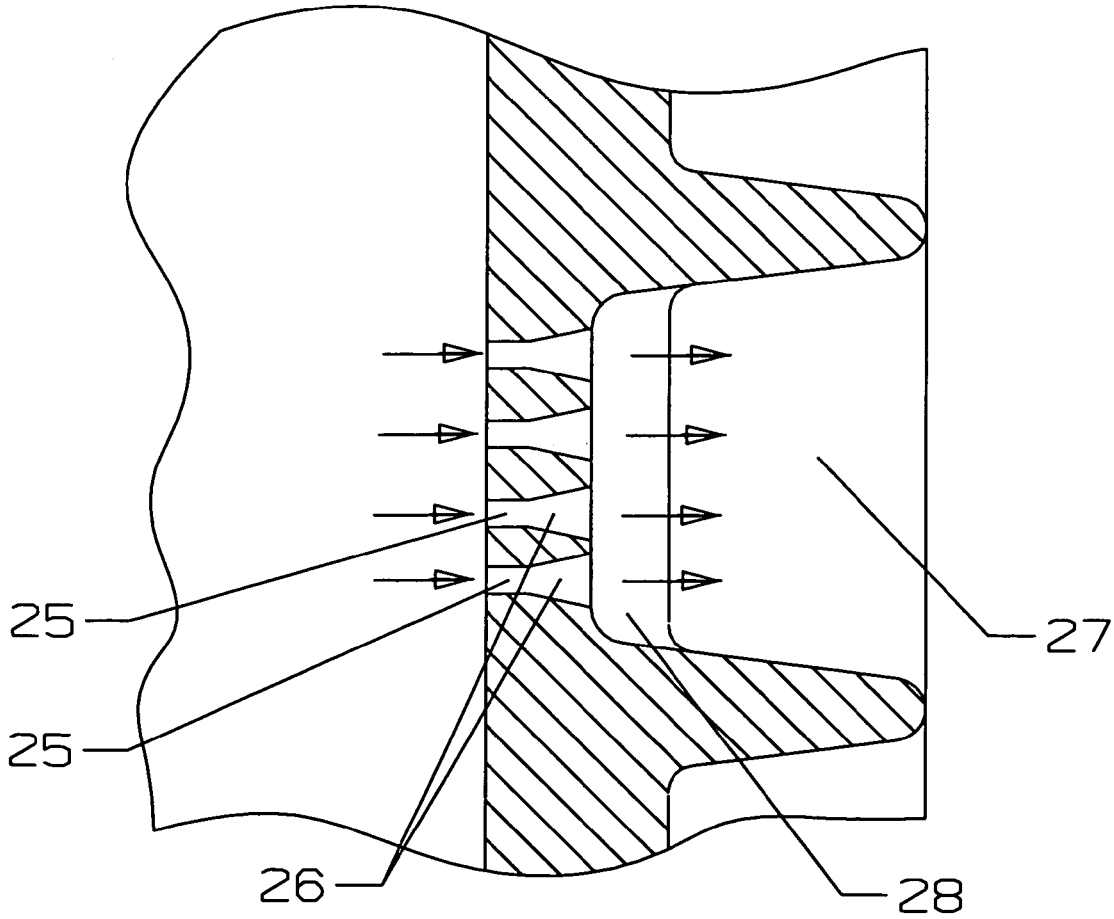
FIG. 6 shows a cross section side view of the trailing edge metering holes and diffusion slot of FIG. 5.

Spaced along the trailing edge of the blade and in fluid communication with the trailing edge cooling channel 23 are a plurality of multi-metering and diffusion cooling slots as seen in FIG. 5 and FIG. 6. FIG. 5 shows a top view of a cross section of the trailing edge multi-metering and diffusion cooling slot which includes a metering hole 25 connected to the trailing edge cooling channel 23. The metering hole 25 leads into a three dimensional cone shaped diffusion hole 26. The first leg 25 of the metering and diffusion hole is constructed with a constant diameter at a length to diameter ratio of from about 2 to about 2.5, the second leg 26 of the metering and diffusion hole spreads the cooling air from the constant diameter hole 25 into a spanwise continuous flow. A plurality of these metering and diffusion holes 25 and 26 lead into a larger open slot 27 that opens along the pressure side of the blade at the trailing edge as seen in FIG. 6. In this embodiment, four metering and diffusion holes 25 and 26 open into one slot 27. However, less than four or more than four metering and diffusion holes 25 and 26 could open into one slot 27 without departing from the spirit and scope of the present invention. The larger slot 27 further functions to diffuse the cooling air. A first diffusion occurs in the cone shaped hole 26, followed by a second diffusion in the beginning 28 of the slot 27 that is formed with continuous side walls, and then a third diffusion in the slot 27 where the pressure side of the slot is open to the airfoil wall surface as seen in FIG. 6. With the multiple diffusion holes of the present invention, the airfoil trailing edge section can be cooled with a small amount of cooling air. Also, the multiple diffusion of cooling air into a large exit slot allows for the acceptance of an airfoil external coating without impact of the cooling flow rate.

At the blade lower span, near wall cooling is used for the reduction of cooling flow cross sectional area, especially for the blade mid-chord section where the highest thickness for the blade occurs. The near wall cooling channels utilized at the blade mid-chord section functions to increase the cooling through velocity and therefore increase the cooling side internal heat transfer coefficient. Since the blade upper span geometry is very thin, the use of near wall cooling channels in the ceramic core may reduce the casting yields and therefore, for the blade upper span height, trip strips are used at the blade serpentine flow channel at higher span to increase the internal heat transfer capability.

In the aft flowing triple or 3-pass serpentine flow cooling circuit of the present invention, the cooling air is channeled into the serpentine flow circuit for providing cooling to the blade leading edge section. Trip strips are used along the entire radial flow channel. In the second leg of the serpentine flow cooling channel, a single flow channel with trip strips is used for the upper blade span. As the flow area increases, the single serpentine flow channel is transformed into multiple near wall flow channels along the airfoil pressure side wall and the suction side wall. Rough surface or trip strips can also be used in the mid-chord near wall cooling channels to increase the turbulence in the cooling air flow. The elimination of the prior art root turn geometry at the tip eliminates the constraint to the cooling flow during the turn, which allows for the cooling air to form a free stream tube at the blade root turn region. In addition to the aerodynamic root turn design benefit, the open serpentine root turn also greatly improves the serpentine ceramic core support to achieve a better casting yield and allow the second leg of the near wall multiple ceramic cores to mate with the third leg of the serpentine flow circuit ceramic core for the completion of the serpentine flow circuit. Trip strip cooling mechanism is used for the entire third leg of the serpentine flow circuit to increase the channel internal heat transfer performance.

The near wall triple or 3-pass serpentine flow cooling circuit of the present invention provides for a highly tapered and twisted blade to have adequate cooling, provides for a lower blade sectional mass average metal temperature, and enhances the blade creep capabilities. The spent cooling air from the triple pass serpentine flow circuit is then used to cool the blade trailing edge thin section. The double usage of cooling air yields a very high overall cooling effectiveness over the prior art drilled cooling radial channels. Also, the present invention allows for a low cooling air flow which will increase the efficiency of the engine.

I claim the following:

1. A rotor blade for use in a gas turbine engine, the rotor blade comprising:

a root portion having a cooling air supply passage;

an airfoil portion extending from the root portion to a blade tip;

a multiple pass serpentine flow cooling circuit formed within the airfoil portion, the serpentine flow cooling circuit including a first leg and a last leg, and a middle leg positioned in the serpentine flow direction between the first and the last legs, the middle leg having an upper portion formed of at least a single channel with trip strips located within the single channel and a lower portion having a plurality of cooling channels in fluid communication with the at least one single channel; and, the cooling channels in the lower portion include a plurality of near wall cooling channels extending along the pressure side of the blade and a plurality of near wall cooling channels extending along the suction side of the blade.

2. The rotor blade of claim 1, and further comprising:

the serpentine flow circuit is a three pass serpentine flow circuit with the first leg on the leading edge of the blade, the second leg including an upper portion formed of a single channel and a lower portion formed from a plurality of near wall channels, and the third or last leg being a trailing edge channel.

3. A rotor blade for use in a gas turbine engine, the rotor blade comprising:

a root portion having a cooling air supply passage;

an airfoil portion extending from the root portion to a blade tip;

a multiple pass serpentine flow cooling circuit formed within the airfoil portion, the serpentine flow cooling circuit including a first leg and a last leg, and a middle leg positioned in the serpentine flow direction between the first and the last legs, the middle leg having an upper portion formed of at least a single channel with trip strips located within the single channel and a lower portion having a plurality of cooling channels in fluid communication with the at least one single channel;

a plurality of exit cooling holes located along the trailing edge of the blade and in fluid communication with the last leg to provide cooling air along the trailing edge of the blade;

the exit holes are metering holes and open into a diffusion hole;

a plurality of diffusion slots arranged along the trailing edge of the blade and opening onto the pressure side;

each diffusion slot being in fluid communication with a plurality of diffusion holes; and, the diffusion slots each having a second diffuser in fluid communication with the diffusion holes, and a third diffusion located downstream from the second diffuser such that cooling air passes through a series of three diffusers before being discharge out from the blade.

4. A large turbine rotor blade for use in a gas turbine engine, the large turbine rotor blade comprising:

a root section;

an airfoil section extending from the root section;

a 3-pass serpentine flow cooling circuit to provide internal cooling for the airfoil section;

the 3-pass serpentine flow cooling circuit including a first leg located along a leading edge section of the airfoil and extending from the root section to a blade tip, a third leg located adjacent to a trailing edge section of the airfoil and extending from the root section to the blade tip;

the 3-pass serpentine flow cooling circuit including a second leg with an upper portion channel and a lower portion channel;

the upper portion channel is formed by a single channel that extends from a pressure side wall to a suction side wall of the airfoil;

the lower portion channel is formed by a plurality of near wall cooling channels formed in the pressure side wall of the airfoil and a plurality of near wall cooling channels formed in the suction side wall of the airfoil.

5. The large turbine rotor blade of claim 4, and further comprising:

a dead cavity formed between the pressure side near wall cooling channels and the suction side near wall cooling channels.

6. The large turbine rotor blade of claim 4, and further comprising:

a collection cavity located in the blade root, the collection cavity being in fluid communication with the plurality of near wall cooling channels and the third leg of the serpentine flow cooling circuit.

7. The large turbine rotor blade of claim 4, and further comprising:

the first and third legs of the serpentine flow cooling circuit both include trip strips on the wall surfaces to enhance heat transfer.

8. The large turbine rotor blade of claim 4, and further comprising:

A plurality of exit cooling holes located along the trailing edge of the blade and in fluid communication with the third leg to provide cooling air along the trailing edge of the blade;

the exit holes are metering holes and open into a diffusion hole;

a plurality of diffusion slots arranged along the trailing edge of the blade and opening onto the pressure side; and, each diffusion slot being in fluid communication with a plurality of diffusion holes.

9. The large turbine rotor blade of claim 4, and further comprising:

the diffusion slots each having a second diffuser in fluid communication with the diffusion holes, and a third diffusion located downstream from the second diffuser such that cooling air passes through a series of three diffusers before being discharge out from the blade.

* * * * *